US007143742B2

(12) United States Patent
Nakane

(10) Patent No.: US 7,143,742 B2
(45) Date of Patent: Dec. 5, 2006

(54) INJECTION QUANTITY CONTROL DEVICE OF INTERNAL COMBUSTION ENGINE

(75) Inventor: Noriaki Nakane, Komaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/053,887

(22) Filed: Feb. 10, 2005

(65) Prior Publication Data

US 2005/0178358 A1 Aug. 18, 2005

(30) Foreign Application Priority Data

Feb. 17, 2004 (JP) ..... 2004-040061

(51) Int. Cl.
*F02D 41/14* (2006.01)
*F02D 41/00* (2006.01)

(52) U.S. Cl. ..... 123/339.15; 123/478

(58) Field of Classification Search ..... 123/339.12, 123/339.15, 339.19, 352, 478, 486
See application file for complete search history.

(56) References Cited

U.S. PATENT DOCUMENTS 4,777,921 A 10/1988 Miyaki et al.
5,058,547 A * 10/1991 Morikawa ..... 123/198 D
5,904,128 A * 5/1999 Shimada et al. ..... 123/339.12
6,755,176 B1 * 6/2004 Takeuchi et al. ..... 123/299
6,845,747 B1 * 1/2005 Rasmussen et al. ..... 123/299

FOREIGN PATENT DOCUMENTS

JP 10-288070 * 10/1998

* cited by examiner

*Primary Examiner*—Mahmoud Gimie
(74) *Attorney, Agent, or Firm*—Nixon & Vanderhye, P.C.

(57) ABSTRACT

An engine control unit (ECU) monitors an idling rotation speed of a diesel engine and predicts a tendency of an increase in an injection quantity occurring until an increasing rate of the injection quantity converges based on an initial tendency of an increase in the idling rotation speed. If the idling rotation speed exceeds a predetermined reference rotation speed, the ECU performs correction (counter control) for reducing the injection quantity. Thus, an increase in the injection quantity due to changes in hardware with time can be eluded, and an increase in an engine output due to the increase in the injection quantity can be inhibited. Therefore, damages to the diesel engine due to an excessive increase in the engine output can be prevented.

14 Claims, 4 Drawing Sheets

INJECTION QUANTITY CONTROL DEVICE OF INTERNAL COMBUSTION ENGINE

CROSS REFERENCE TO RELATED APPLICATION

This application is based on and incorporates herein by reference Japanese Patent Application No. 2004-40061 filed on Feb. 17, 2004.

BACKGROUND OF THE INVENTION

1. Field of the Invention

The present invention relates to an injection quantity control device of an internal combustion engine suitable for a construction machine, an agricultural machine and the like.

2. Description of Related Art

A common rail type fuel injection system for a diesel engine is publicly known, for instance, as described in Unexamined Japanese Patent Application Publication No. S62-258160 (Patent Document 1). The fuel injection system has a common rail for accumulating fuel, which is pressure-fed from a fuel supply pump, at a predetermined injection pressure, and injectors for injecting the high-pressure fuel, which is supplied from the common rail, into cylinders of the diesel engine. An electronic control unit (ECU) controls an injection quantity and injection timing of the fuel injected by the injectors.

In the above common rail type fuel injection system, electric abnormalities in sensors can be detected by the ECU. However, changes in hardware such as an increase in the injection quantity (an increase in an output of the engine) due to a change in the injector with time (for instance, fitting abrasion of a nozzle seat) cannot be detected in the present circumstances. As a solution for the above problem, a design change and the like are performed to reduce the abrasion of the nozzle seat. However, complete settlement is not achieved because other factors of the changes exist.

The degree of progression of the changes in the hardware with time differs among individuals. For instance, in a certain engine in which the changes progress relatively quickly, an engine output increases by 15 to 20 percent in several tens of hours as shown by a solid line "a" in FIG. 6, while an engine output of another engine increases relatively slowly as shown by a solid line "b". An axis of ordinates in FIG. 6 indicates a ratio y of the increase in the engine output. Specifically, the engine mounted in a construction machine or an agricultural machine is usually used in a range from peak torque to the maximum output point. Therefore, if an injection over a rated output is performed because of the changes in the hardware with time, there is a possibility that reliability of the engine is adversely affected. Therefore, engine manufacturers sometimes set the maximum output in consideration of the increase in the output due to the changes in the hardware with time. In such cases, the maximum output is set at a value lower than an available output by 10 to 15 percent, for instance. However, this policy is disadvantageous in competition of improvement of the engine output.

SUMMARY OF THE INVENTION

It is therefore an object of the present invention to provide an injection quantity control device of an internal combustion engine capable of forestalling damages to the engine due to an increase in an engine output by predicting a tendency, or a pattern, of an increase in an injection quantity due to changes in hardware with time and by performing correction for reducing the injection quantity in an early stage in accordance with the tendency of the increase.

According to an aspect of the present invention, an injection quantity control device of an internal combustion engine monitors an idling rotation speed of the engine. Meanwhile, the control device predicts a future tendency of an increase in an injection quantity based on an initial tendency of an increase in the idling rotation speed. If the idling rotation speed exceeds a predetermined reference rotation speed, the control device performs correction for reducing the injection quantity to cancel the increase tendency of the injection quantity.

In the above structure, if the idling rotation speed exceeds the reference rotation speed, the correction for reducing the injection quantity is performed in an early stage. Therefore, an increase in the injection quantity due to changes in hardware with time can be inhibited. As a result, an increase in an output of the engine due to the increase in the injection quantity can be inhibited. Thus, damages to the engine due to an excessive increase in the engine output can be prevented.

In the present invention, the tendency of the increase in the injection quantity is predicted based on the initial tendency of the increase in the idling rotation speed, and the correction for reducing the injection quantity is performed to cancel the increase tendency. Therefore, there is no need to execute the program every time the engine enters the idling mode. Thus, a load on the control device can be alleviated.

According to another aspect of the present invention, the injection quantity control device includes storing means, determining means, and correcting means. The storing means stores multiple patterns of the increase in the injection quantity respectively corresponding to different tendencies of the increase in the injection quantity. The determining means determines one injection quantity increase pattern corresponding to the initial tendency of the increase in the idling rotation speed out of the multiple injection quantity increase patterns. The correcting means performs the correction for reducing the injection quantity to cancel the injection quantity increase pattern determined by the determining means if the idling rotation speed exceeds the reference rotation speed.

In the above structure, one injection quantity increase pattern corresponding to the initial increase tendency of the idling rotation speed can be selected out of the multiple injection quantity increase patterns stored beforehand. Therefore, the increase tendency of the idling rotation speed can be easily estimated. Accurate correction can be performed by performing the reduction correction of the injection quantity for canceling the selected injection quantity increase pattern.

According to yet another aspect of the present invention, the determining means of the injection quantity control device determines the injection quantity increase pattern corresponding to the initial tendency of increase in the idling rotation speed based on a time for the idling rotation speed to reach the reference rotation speed.

In the above structure, as the time for the idling rotation speed to reach the reference rotation speed shortens, an increasing rate of the injection quantity increases. As the time for the idling rotation speed to reach the reference rotation speed lengthens, the increasing rate of the injection quantity decreases. Therefore, the injection quantity increase pattern can be selected in accordance with the increasing rate of the injection quantity.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
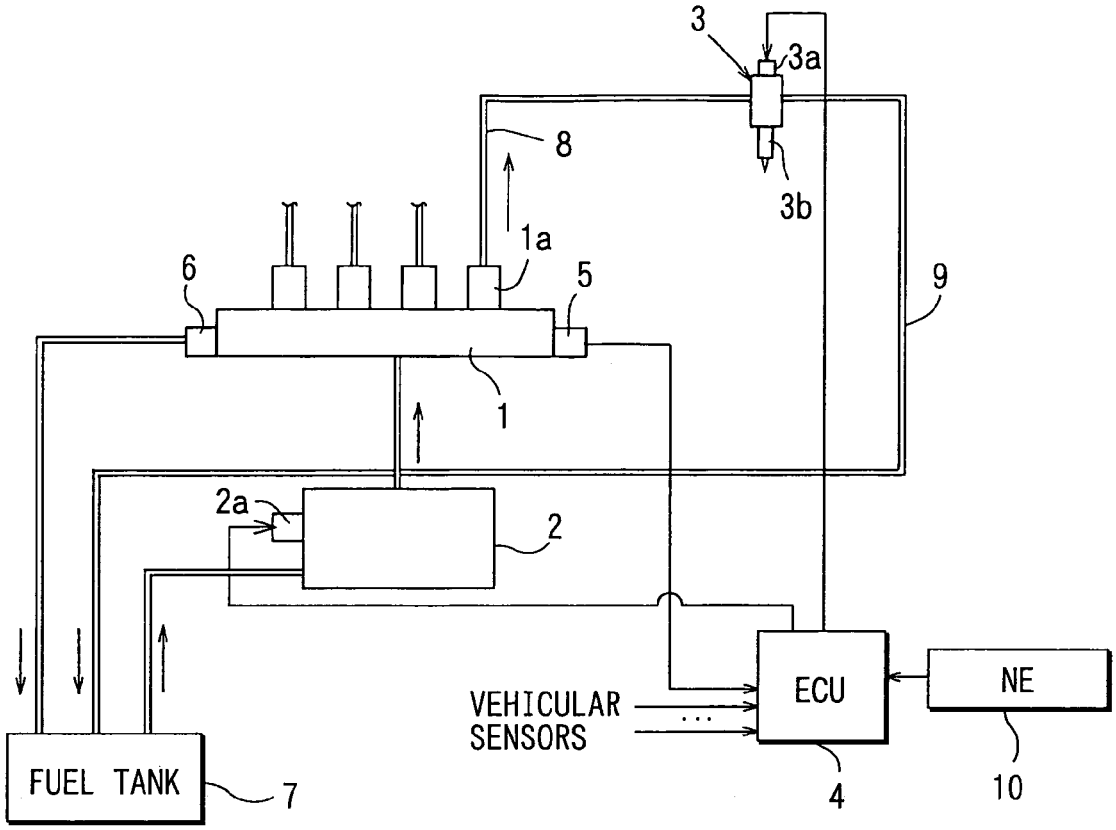
FIG. 1 is a schematic diagram showing a common rail type fuel injection system according to an embodiment of the present invention.

Referring to FIG. 1, a common rail type fuel injection system according to an embodiment of the present invention is illustrated.

For instance, the common rail type fuel injection system shown in FIG. 1 is applied to a diesel engine mounted in a construction machine or an agricultural machine. The fuel injection system includes a common rail 1, a fuel supply pump 2, injectors 3, an engine control unit (ECU) 4 and the like. The common rail 1 accumulates high-pressure fuel. The fuel supply pump 2 supplies the fuel to the common rail 1. The injectors 3 inject the high-pressure fuel, which is supplied from the common rail 1, into cylinders of the engine. The ECU 4 electronically controls operation of the system.

The common rail 1 accumulates the high-pressure fuel, which is supplied from the fuel supply pump 2, based on a target rail pressure set in accordance with an engine rotation speed NE and a load (an accelerator position). A pressure sensor 5 and a pressure limiter 6 are attached to the common rail 1. The pressure sensor 5 senses a fuel pressure (a rail pressure) and outputs the sensed value to the ECU 4. The pressure limiter 6 limits an upper limit of the rail pressure.

The fuel supply pump 2 includes a feed pump, an electromagnetic quantity regulation valve 2*a*, a pump function and the like. The feed pump draws the fuel from a fuel tank 7. The electromagnetic quantity regulation valve 2*a* regulates a quantity of the fuel discharged by the feed pump. The pump function pressurizes the fuel, of which quantity is regulated by the quantity regulation valve 2*a*, and pressure-feeds the fuel to the common rail 1.

The injectors 3 are mounted to the respective cylinders of the engine. Each injector 3 is connected with a discharge hole 1*a* of the common rail 1 through a high-pressure pipe 8. The injector 3 includes an electromagnetic valve 3*a* and a nozzle 3*b*. The electromagnetic valve 3*a* operates responsive to a command of the ECU 4. An injection quantity and injection timing of the nozzle 3*b* is controlled in accordance with opening and closing operation of the electromagnetic valve 3*a*. Surplus fuel, which is not injected from the nozzle 3*b*, is returned to the fuel tank 7 through a leak passage 9.

The ECU 4 is connected with a rotation speed sensor 10 for sensing the engine rotation speed NE, an accelerator position sensor for sensing the accelerator position (the engine load), the pressure sensor 5, and the like. Based on information obtained through the above sensors, the ECU 4 calculates a target rail pressure of the common rail 1, and optimum injection timing and injection quantity for an operating state of the engine. Based on the result of the calculation, the ECU 4 electronically controls the electromagnetic quantity regulation valve 2*a* of the fuel supply pump 2, the electromagnetic valves 3*a* of the injectors 3, and the like.

In order to inhibit an increase in the injection quantity (an increase in an output of the engine) due to changes in hardware of the system with time, the ECU 4 performs correction (counter control) for reducing the injection quantity when an idling rotation speed of the engine exceeds a predetermined reference rotation speed.

"Fitting abrasion" (explained below) caused when the injector 3 is repeatedly used is representative of the changes in the hardware with time.

Figure 2A:
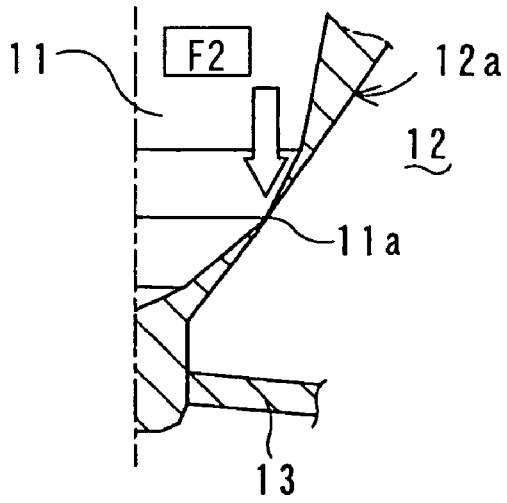
FIG. 2A is a sectional view showing a neighborhood of a seat portion and a seat surface of an injector of the fuel injection system according to the embodiment.
Figure 2B:
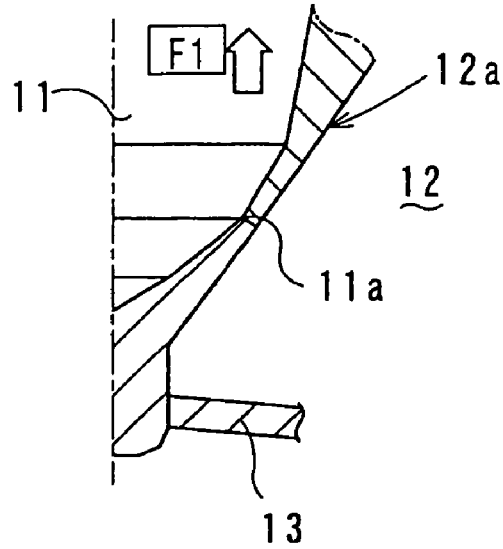
FIG. 2B is another sectional view showing the neighborhood of the seat portion and the seat surface of the injector of the fuel injection system according to the embodiment.

If the injector 3 is in an injection stopping period in which the electromagnetic valve 3*a* is deenergized, a seat portion 11*a* of a needle 11 is pressed by a load F2 against a seat surface 12*a* of a nozzle body 12 as shown in FIG. 2A. If the electromagnetic valve 3*a* is energized, the needle 11 is pushed up by a load F1, which is greater than the load F2, as shown in FIG. 2B. Thus, the seat portion 11*a* separates from the seat surface 12*a*, and the high-pressure fuel is injected through an injection hole 13.

Figure 2C:
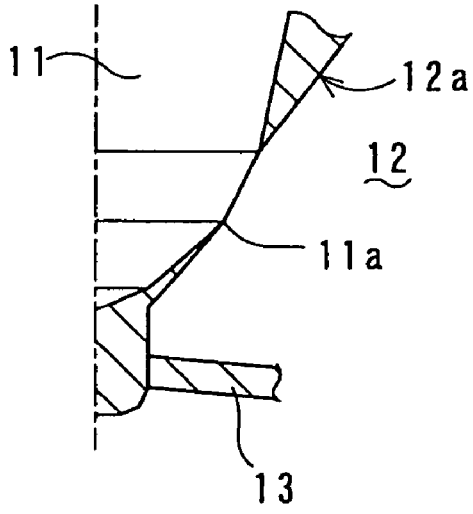
FIG. 2C is another sectional view showing the neighborhood of the seat portion and the seat surface of the injector of the fuel injection system according to the embodiment.
Figure 2D:
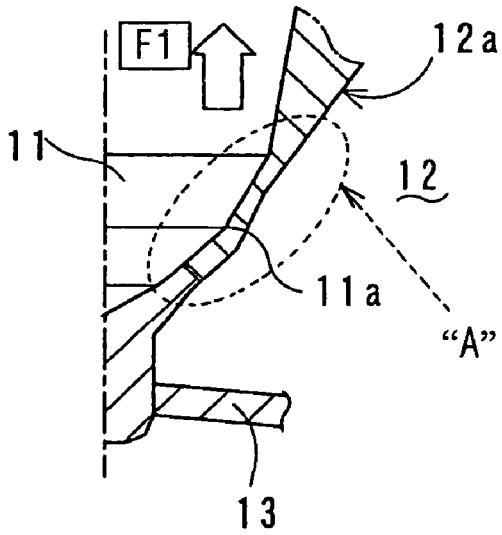
FIG. 2D is yet another sectional view showing the neighborhood of the seat portion and the seat surface of the injector of the fuel injection system according to the embodiment.

If the reciprocation of the needle 11 is repeated, the load F2 is applied to the seat surface 12*a* every time the seat portion 11*a* is seated on the seat surface 12*a*. Therefore, as shown in FIG. 2C, the seat surface 12*a* is abraded along the shape of the seat portion 11*a*. This phenomenon is referred to as the fitting abrasion. If the abrasion of the seat surface 12*a* progresses, a pressure receiving area of the needle 11 shown in an area A in FIG. 2D, which receives an upward fuel pressure in FIG. 2D immediately after the needle 11 starts lifting, will be enlarged. Therefore, the load F1 pushing up the needle 11 increases. Accordingly, an injection rate increases and a lifting distance of the needle 11 also increases. As a result, the injection quantity increases.

Figure 3:
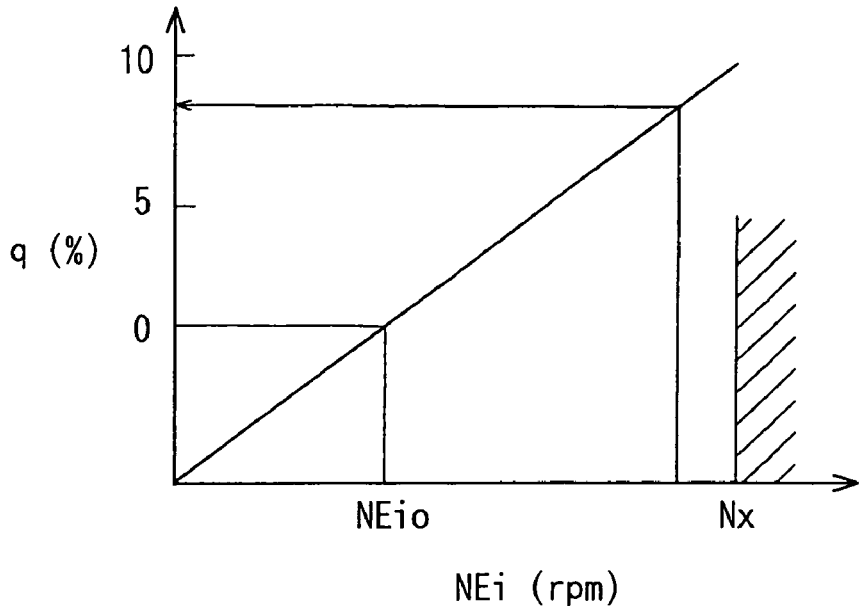
FIG. 3 is a characteristic graph showing a relationship between an injection quantity and an idling rotation speed according to the embodiment.

The ECU 4 cannot directly detect the increase in the injection quantity due to the change in the injector 3 with time (the abrasion of the seat surface 12*a*). However, the change in the injection quantity can be detected by monitoring the engine rotation speed in an idling period (a no-load state), or an idling rotation speed NEi of the engine, as shown in FIG. 3. A graph in FIG. 3 shows a relationship between an increasing rate q of the injection quantity and the idling rotation speed NEi. In FIG. 3, a value NEi0 is an initial setting value of the idling rotation speed NEi.

The ECU 4 performs the counter control with the use of the above method of estimating the change in the injection quantity from the change in the idling rotation speed NEi.

Figure 4:
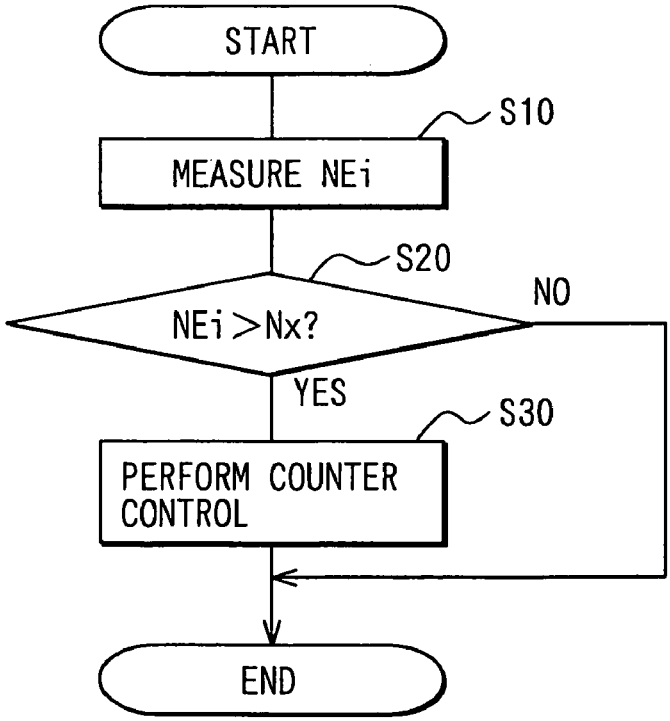
FIG. 4 is a flowchart showing processing steps of counter control performed by an engine control unit according to the embodiment.

Next, processing steps of the counter control performed by the ECU 4 of the embodiment will be explained based on a flowchart shown in FIG. 4.

First, in Step S10, the idling rotation speed NEi of the engine is measured by using the rotation speed sensor 10.

Then, in Step S20, it is determined whether the idling rotation speed NEi is higher than a predetermined reference rotation speed Nx. The reference rotation speed Nx is calculated by converting a limit of strength of the diesel engine, which is obtained based on the increasing rate of the injection quantity, into a threshold of the idling rotation speed NEi. If the result of the determination in Step S20 is "YES", the processing proceeds to following Step S30. If the result of the determination in Step S20 is "NO", the processing is ended without performing the counter control.

In Step S30, the counter control is performed.

Figure 5:
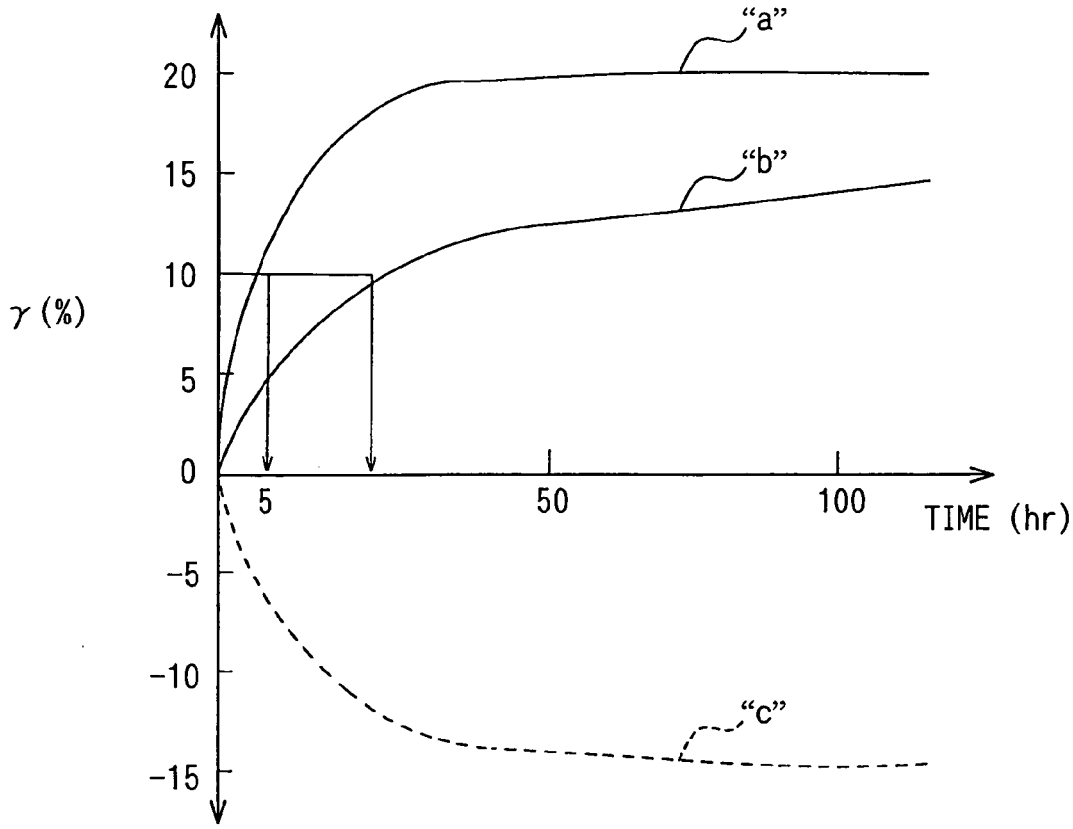
FIG. 5 is a time chart showing output increase patterns and characteristics of the counter control according to the embodiment.
Figure 6:
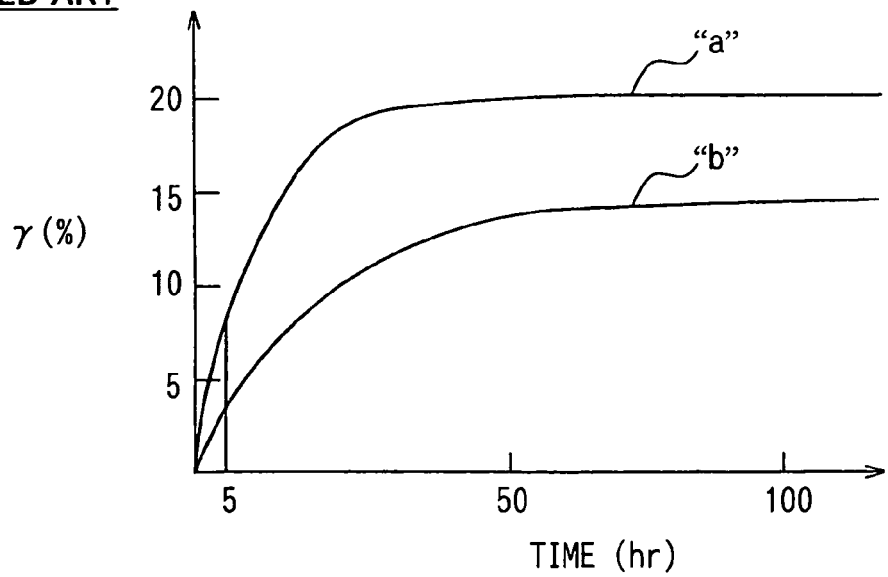
FIG. 6 RELATED ART
FIG. 6 is a graph showing an increasing rate of an engine output of a related art with respect to an elapsed time.

The ECU 4 beforehand stores multiple patterns of the increase in the injection quantity respectively corresponding to different tendencies of the increase in the injection quantity (the engine output). For instance, the ECU 4 beforehand stores a pattern of a steep increase shown by a solid line "a" in FIG. 5 and a pattern of a gradual increase shown by a solid line "b" in FIG. 5. It is determined whether the injection quantity increase pattern (the pattern of the increase in the injection quantity) is the steep increase pattern or the gradual increase pattern based on a time for the idling rotation speed NEi to reach the reference rotation speed Nx. The injection quantity increase pattern denotes the injection quantity increase tendency (the tendency of the increase in the injection quantity) occurring until the increasing rate of the injection quantity converges. The injection quantity increase patterns of FIG. 5 are obtained by performing simulations of several models having different initial tendencies of the increase in the injection quantity, based on the tendency of increase in the injection quantity (the tendency occurring until the increasing rate of the injection quantity converges), which is measured with the use of a real machine beforehand.

If the injection quantity increase pattern is determined, the injection pulse width, which is outputted to the injector 3 (the electromagnetic valve 3*a*), is corrected and reduced based on an injection quantity decrease pattern (for instance, a pattern shown by a broken line "c" in FIG. 5) for canceling the injection quantity increase pattern. The injection quantity decrease pattern is an inverse pattern of the injection quantity increase pattern. For instance, a steep decrease pattern corresponding to the steep increase pattern and a gradual decrease pattern corresponding to the gradual increase pattern are stored in the memory beforehand.

Thus, by performing the above counter control, the future increase in the injection quantity due to the changes in the hardware with time can be eluded. As a result, an excessive increase of the output of the diesel engine due to the increase in the injection quantity can be inhibited. Thus, damages to the diesel engine due to the increase in the output can be prevented.

In the present embodiment, the tendency occurring until the increasing rate of the injection quantity converges is predicted from the initial tendency of the increase in the idling rotation speed NEi, and the counter control for canceling the increase tendency is performed in the early stage. Therefore, there is no need to execute the correction program (the counter control) every time the engine enters an idling mode. As a result, the load on the ECU 4 can be alleviated.

Since the multiple injection quantity increase patterns corresponding to the different injection quantity increase tendencies are stored in the memory beforehand, the arithmetic load of the ECU 4 can be greatly alleviated.

In the present embodiment, the injection quantity increase pattern is determined based on the time for the idling rotation speed NEi to reach the reference rotation speed Nx. Alternatively, the injection quantity increase pattern may be estimated based on the initial tendency of the increase in the idling rotation speed NEi before the idling rotation speed NEi reaches the reference rotation speed Nx.

In the present embodiment, the two types of injection quantity increase patterns (the steep increase pattern and the gradual increase pattern) are stored and used. More precise counter control can be performed by increasing the number of types of the injection quantity increase patterns stored in the ECU 4.

In the present embodiment, the counter control is performed in the early stage. Therefore, there is a possibility that the output of the engine becomes lower than a regular engine output if the injection pulse width outputted to the injector 3 (the electromagnetic valve 3*a*) is reduced greatly. Therefore, instead of reducing the injection pulse width by the entire correction value in the counter control, gradual correction may be performed so that the injection pulse width is corrected moderately at first by a relatively small correction value, and then, the correction value is increased gradually.

The present invention should not be limited to the disclosed embodiment, but may be implemented in many other ways without departing from the spirit of the invention.

What is claimed is:

1. An injection quantity control device of an internal combustion engine, the control device monitoring an idling rotation speed of the engine, the control device comprising:

determining means for predicting a future tendency of an increase in an injection quantity by determining an injection quantity increase pattern corresponding to an initial tendency of an increase in the idling rotation speed based on a time for the idling rotation speed to reach a predetermined reference rotation speed, and correcting means for performing correction for reducing the injection quantity to cancel the tendency of the injection quantity increase pattern determined by the determining means such that the increase tendency of the injection quantity is canceled if the idling rotation speed exceeds the predetermined reference rotation speed.

2. The injection quantity control device as in claim 1, further comprising:

storing means for beforehand storing multiple injection quantity increase patterns of different increase tendencies of the injection quantity; wherein the determining means determines one injection quantity increase pattern corresponding to the initial tendency of the increase in the idling rotation speed out of the multiple injection quantity increase patterns.

3. The injection quantity control device as in claim 1, wherein the control device estimates a degree of the future tendency of the increase in the injection quantity based on a time for the idling rotation speed to reach the reference rotation speed.

4. The injection quantity control device as in claim 1, wherein the increase in the injection quantity is due to a change in hardware of a component of the control device over time.

5. The injection quantity control device as in claim 4, wherein the change in hardware of a component is a fitting abrasion of a fuel injector.

6. A method of controlling injection quantity in an internal combustion engine, the method comprising:

monitoring an idling rotation speed of the engine;

predicting a future tendency of an increase in an injection quantity by determining an injection quantity increase pattern corresponding to an initial tendency of an increase in the idling rotation speed based on a time for the idling rotation speed to reach a predetermined reference rotation speed; and performing correction for reducing the injection quantity to cancel the tendency of the determined injection quantity increase pattern such that the increase tendency of the injection quantity is canceled if the idling rotation speed exceeds the predetermined reference rotation speed.

7. The method as in claim 6, further comprising:

storing multiple injection quantity increase patterns of different increase tendencies of the injection quantity; wherein said determining an injection quantity increase pattern determines one injection quantity increase pattern as corresponding to the initial tendency of the increase in the idling rotation speed out of the multiple injection quantity increase patterns.

8. The method as in claim 6, further comprising estimating a degree of the future tendency of the increase in the injection quantity based on a time for the idling rotation speed to reach the reference rotation speed.

9. The method as in claim 6, wherein the increase in the injection quantity is due to a change in hardware of a component of the engine over time.

10. The method as in claim 9, wherein the change in hardware of a component is a fitting abrasion of a fuel injector.

11. A method of controlling injection quantity in an internal combustion engine, the method comprising:

monitoring an idling rotation speed of the engine;

determining a particular one of different injection quantity increase patterns based on the idling rotation speed;

reducing the injection quantity to cancel the particular one of the injection quantity increase patterns if the idling rotation exceeds a predetermined reference rotation speed;

wherein the particular one of the injection quantity increase patterns is determined based on a time for the idling rotation speed to reach the reference rotation speed.

12. The method as in claim 11, wherein the injection quantity is reduced based on a predetermined injection quantity decrease pattern.

13. The method as in claim 11, wherein an increase in the injection quantity is caused by a change in hardware of a component of the engine over time.

14. The method as in claim 13, wherein the change in hardware of a component is a fitting abrasion of a fuel injector.

* * * * *